US009400477B2

(12) United States Patent
Nishikawa et al.

(10) Patent No.: US 9,400,477 B2
(45) Date of Patent: Jul. 26, 2016

(54) CLEANING DEVICE, DEVICE TO BE CLEANED, CLEANING MEMBER, AND IMAGE FORMING APPARATUS

(71) Applicant: FUJI XEROX CO., LTD., Tokyo (JP)

(72) Inventors: Satoru Nishikawa, Kanagawa (JP); Akira Numazaki, Kanagawa (JP); Hirotake Eguchi, Kanagawa (JP); Shinya Mitorida, Kanagawa (JP); Satoshi Takada, Kanagawa (JP); Taichi Fuchu, Kanagawa (JP); Nobuyuki Otani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/310,621

(22) Filed: Jun. 20, 2014

(65) Prior Publication Data

US 2015/0104212 A1 Apr. 16, 2015

(30) Foreign Application Priority Data

Oct. 11, 2013 (JP) ..... 2013-213893

(51) Int. Cl.
*G03G 21/00* (2006.01)
*G03G 15/04* (2006.01)

(52) U.S. Cl.
CPC ..... *G03G 21/0035* (2013.01); *G03G 15/04* (2013.01)

(58) Field of Classification Search
USPC ..... 399/98
See application file for complete search history.

(56) References Cited

U.S. PATENT DOCUMENTS

| | | | | |
|---|---|---|---|---|
| 7,436,426 | B2 * | 10/2008 | Lim | G02B 7/1821 347/152 |
| 8,081,200 | B2 * | 12/2011 | Yamada | G03G 15/326 347/130 |
| 8,364,055 | B2 * | 1/2013 | Ashida | G03G 15/04072 399/98 |
| 2006/0001980 | A1 * | 1/2006 | Namba | G03G 21/1666 359/649 |
| 2007/0182806 | A1 * | 8/2007 | Kobayashi | G03G 15/04045 347/158 |
| 2012/0230722 | A1 * | 9/2012 | Tanaka | G03G 15/0291 399/100 |
| 2014/0241773 | A1 * | 8/2014 | Mochizuki | G03G 21/0029 399/351 |

FOREIGN PATENT DOCUMENTS

JP A-2001-343876 12/2001

* cited by examiner

*Primary Examiner* — W B Perkey
*Assistant Examiner* — Linda B Smith
(74) *Attorney, Agent, or Firm* — Oliff PLC; James A. Oliff

(57) ABSTRACT

A cleaning device includes a cleaning member that includes a cleaning portion that cleans a light transmission member, which has a substantially elongated shape and which transmits light, and a support portion that supports the cleaning portion and a wall portion that is disposed on one end side of the light transmission member in a longitudinal direction of the light transmission member and that has a surface that is formed along a direction that intersects the longitudinal direction of the light transmission member. The cleaning member and the wall portion each have a configuration in which when an end of the cleaning member makes contact with the wall portion and is pressed, the support portion is bent in a convex manner toward a side opposite to a side on which the light transmission member is disposed.

4 Claims, 11 Drawing Sheets

FIG. 3A
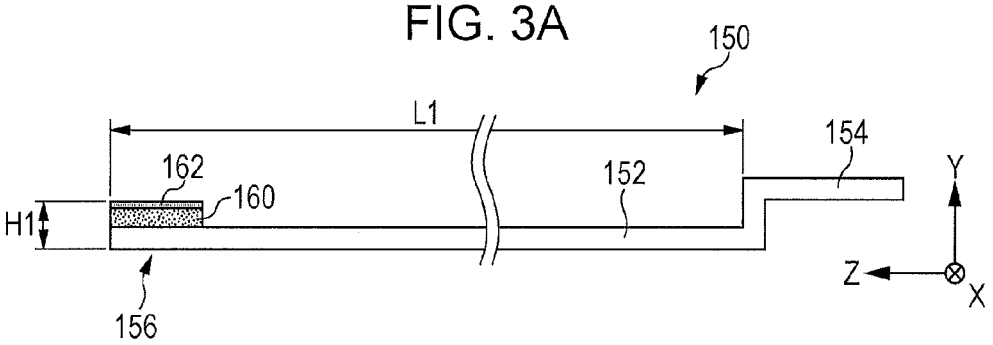
FIG. 3B
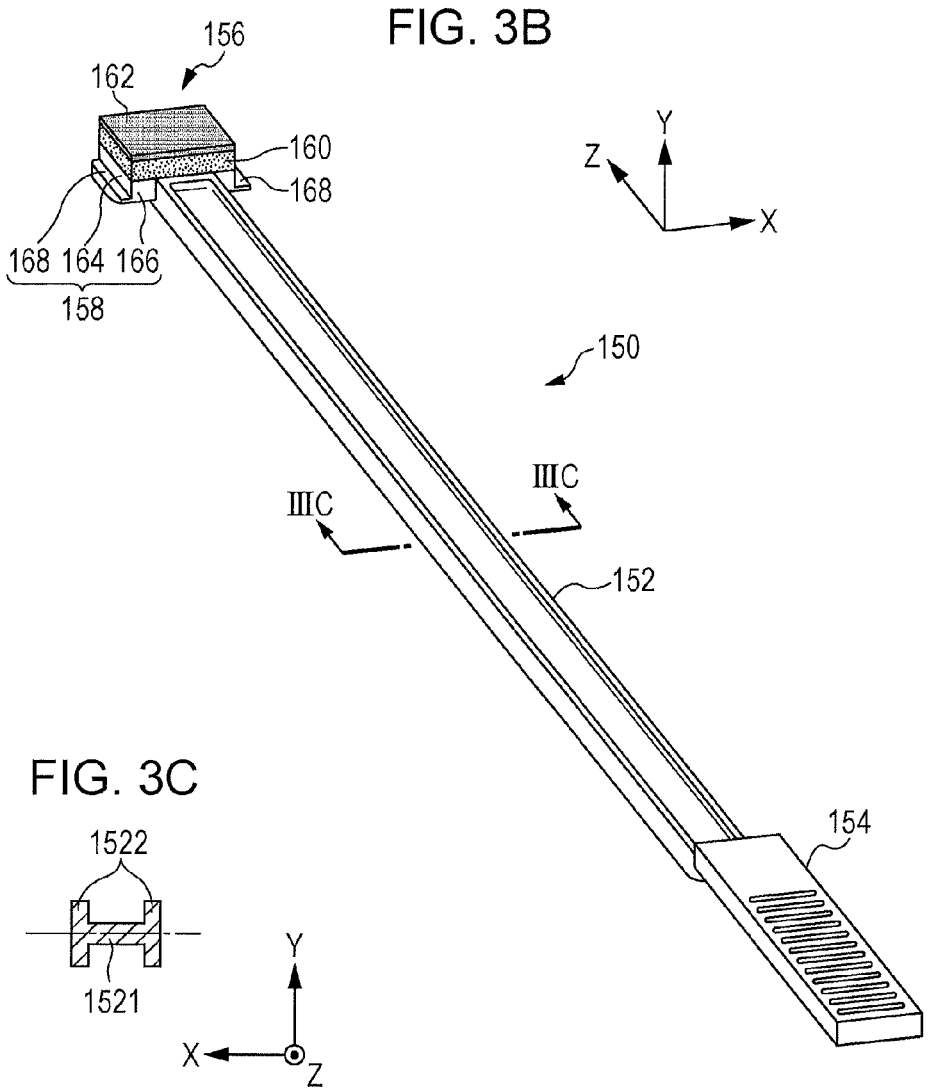
FIG. 3C

CLEANING DEVICE, DEVICE TO BE CLEANED, CLEANING MEMBER, AND IMAGE FORMING APPARATUS

CROSS-REFERENCE TO RELATED APPLICATIONS

This application is based on and claims priority under 35 USC 119 from Japanese Patent Application No. 2013-213893 filed Oct. 11, 2013.

BACKGROUND

Technical Field

The present invention relates to a cleaning device, a device to be cleaned, a cleaning member, and an image forming apparatus.

SUMMARY

According to an aspect of the invention, there is provided a cleaning device including a cleaning member that includes a cleaning portion that cleans a light transmission member, which has a substantially elongated shape and which transmits light, and a support portion that supports the cleaning portion and a wall portion that is disposed on one end side of the light transmission member in a longitudinal direction of the light transmission member and that has a surface that is formed along a direction that intersects the longitudinal direction of the light transmission member. The cleaning member and the wall portion each have a configuration in which when an end of the cleaning member makes contact with the wall portion and is pressed, the support portion is bent in a convex manner toward a side opposite to a side on which the light transmission member is disposed.

BRIEF DESCRIPTION OF THE DRAWINGS

Exemplary embodiments of the present invention will be described in detail based on the following figures, wherein:

FIGS. 3A to 3C are schematic diagrams illustrating the cleaning member that is included in a cleaning device of the first exemplary embodiment;

DETAILED DESCRIPTION

First Exemplary Embodiment

Figure 1:
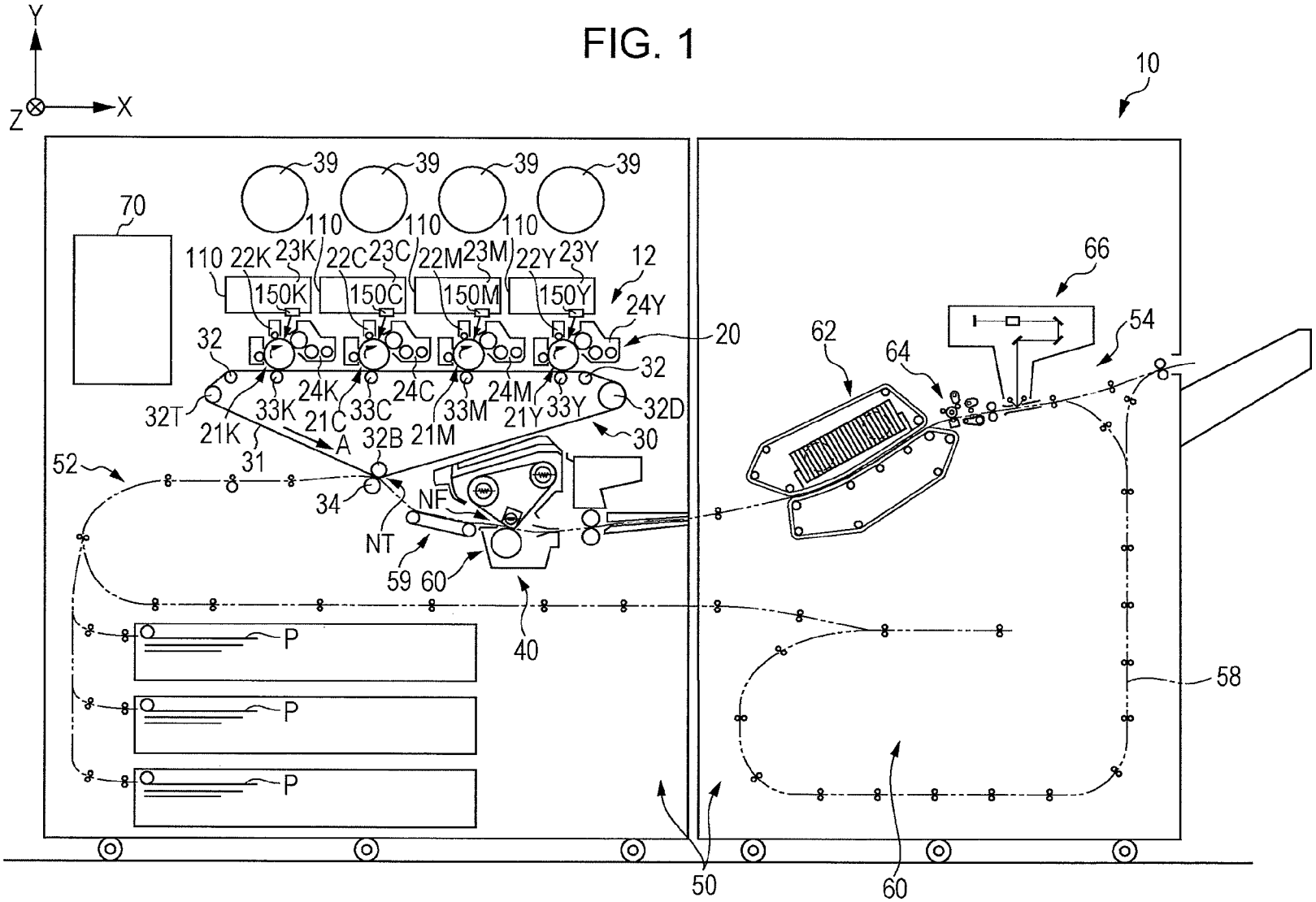
FIG. 1 is a schematic diagram illustrating the overall configuration of an image forming apparatus of a first exemplary embodiment.

An example of a first exemplary embodiment will be described below with reference to FIG. 1 to FIG. 4C. First, the overall configuration and operation of an image forming apparatus will be described, and after that, the configuration and operation of a cleaning device of an exposure device, which is a principal portion of the first exemplary embodiment, will be described. Note that, in the following description, the direction that is indicated by arrow Y in FIG. 1 is a height direction of the image forming apparatus, and the direction that is indicated by arrow X in FIG. 1 is a width direction of the image forming apparatus. In addition, a direction (suitably indicated by arrow Z) that is perpendicular to the height direction of the image forming apparatus and the width direction of the image forming apparatus is a depth direction of the image forming apparatus.

<Configuration of Image Forming Apparatus>

FIG. 1 is a schematic diagram illustrating the overall configuration of an image forming apparatus 10 according to the first exemplary embodiment as seen from the front. As illustrated in FIG. 1, the image forming apparatus 10 includes an image forming unit 12 that forms an image on a medium P by an electrophotographic system, a medium transport unit 50 that transports the medium P, and a subsequent processing unit 60 that performs a subsequent operation and the like on the medium P on which an image has been formed. In addition, the image forming apparatus 10 includes a controller 70 that controls the above-described units.

[Image Forming Unit]

The image forming unit 12 includes toner image forming units 20 each of which forms a toner image, a transfer device 30 that transfers the toner images, which have been formed by the toner image forming units 20, onto the medium P, and a fixing device 40 that fixes the toner images, which have been transferred to the medium P, onto the medium P.

<Toner Image Forming Unit>

Each of the toner image forming units 20 includes a photoconductor drum 21, a charger 22, an exposure device 23, and a developing device 24. The multiple toner image forming units 20 are provided in order to form toner images of different colors. In the first exemplary embodiment, the toner image forming units 20 for four colors of yellow (Y), magenta (M), cyan (C), and black (K) are provided. The letters "Y", "M", "C", and "K" in FIG. 1 represent the above-mentioned corresponding colors. In the transfer device 30, toner images of the four colors are superposed with one another and transferred onto a transfer belt 31 in a first transfer process, and the toner images of the four colors are transferred onto the medium P from the transfer belt 31 at a transfer nip NT. Here, each of the photoconductor drums 21 is an example of a member to be light-irradiated. Each of the exposure devices 23 is an example of a light radiation device.

(Photoconductor Drum)

Each of the photoconductor drums 21 is formed in a cylindrical shape and configured to be driven by a driving unit (not illustrated) so as to rotate about its own axis. As an example, a photosensitive layer having a negative charge polarity is formed on the outer circumferential surface of each of the photoconductor drums 21. Alternatively, an overcoat layer may be formed on the outer circumferential surface of each of the photoconductor drums 21. The photoconductor drums 21 for different colors are linearly arranged next to one another along a width direction of the image forming apparatus 10 (hereinafter referred to as "an apparatus width direction") as seen from the front.

(Charger)

Each of the chargers 22 is configured to charge the outer circumferential surface (a photosensitive layer) of a corresponding one of the photoconductor drums 21 so as to have a negative polarity. In the first exemplary embodiment, each of the chargers 22 is a corona discharge type (non-contact charging type) scorotron charger.

(Exposure Device)

Each of the exposure devices 23 is configured to form an electrostatic latent image on the outer circumferential surface of a corresponding one of the photoconductor drums 21. More specifically, each of the exposure devices 23 is configured to radiate a modulated exposure light beam L onto the outer circumferential surface of the corresponding photoconductor drum 21, which has been charged by the corresponding charger 22, in accordance with image data that is received from an image signal processing unit that is included in the controller 70. The radiation of the exposure light beams L enables electrostatic latent images to be formed on the outer circumferential surfaces of the photoconductor drums 21. In the first exemplary embodiment, each of the exposure devices 23 is configured to cause a light beam that is radiated from a light source 26 (not illustrated) to scan by using a light scanning unit (an optical system), which includes a polygon mirror and an fθ lens, and expose the outer circumferential surface of the corresponding photoconductor drum 21 to the light beam. Here, each of the exposure light beams L is an example of light.

Each of the exposure devices 23 is accommodated in a container 110. In addition, each of the containers 110 is supported by a support frame 190 (see FIGS. 2A and 2B).

A transmission glass 112 having an elongated shape or a substantially elongated shape is fixed to a lower portion of each of the containers 110 in a height direction of the image forming apparatus 10 (hereinafter referred to as "an apparatus height direction") in such a manner that the longitudinal direction of the transmission glass 112 is parallel to a depth direction of the image forming apparatus 10 (hereinafter referred to as "an apparatus depth direction"). A distance L2 from one end of each of the transmission glasses 112 to the other end of the transmission glass 112 in the apparatus depth direction is set to be smaller than a distance L3 from one end of the corresponding container 110 to the other end of the container 110 in the apparatus depth direction, and the ends of the transmission glass 112 are positioned in an area located between the ends of the container 110 as seen from the apparatus depth direction. The position of the proximal end of each of the transmission glasses 112 in the apparatus depth direction is spaced apart from the proximal end of the corresponding container 110 in the apparatus depth direction by a distance L4 (see FIG. 4A). Here, the term "an elongated shape" implies a bar-like shape, a rectangular parallelepiped shape having four rectangular side surfaces, or another similar shape and implies a shape having a side surface the length of which is longer than that of the other side surface in one direction. In this case, each of the ends of the transmission glass 112 in one direction may be formed in such a manner as to have a curved surface.

In addition, each of the transmission glasses 112 is disposed at a position in an optical path of the corresponding exposure light beam L that is emitted from the light source 26. The transmission glasses 112 transmit the corresponding exposure light beams L that are radiated onto the outer circumferential surfaces of the corresponding photoconductor drums 21. A distance L0 from one end of an area CL in which one of the exposure light beams L penetrates the corresponding transmission glass 112 to the other end of the area CL in the apparatus depth direction is set to be smaller than the distance L2 (see FIG. 4A). Here, each of the transmission glasses 112 is an example of a light transmission member having an elongated shape or a substantially elongated shape. Each of the areas CL is an example of a cleaning area (hereinafter referred to as "a cleaning area CL").

(Cleaning Device)

Figure 4A:
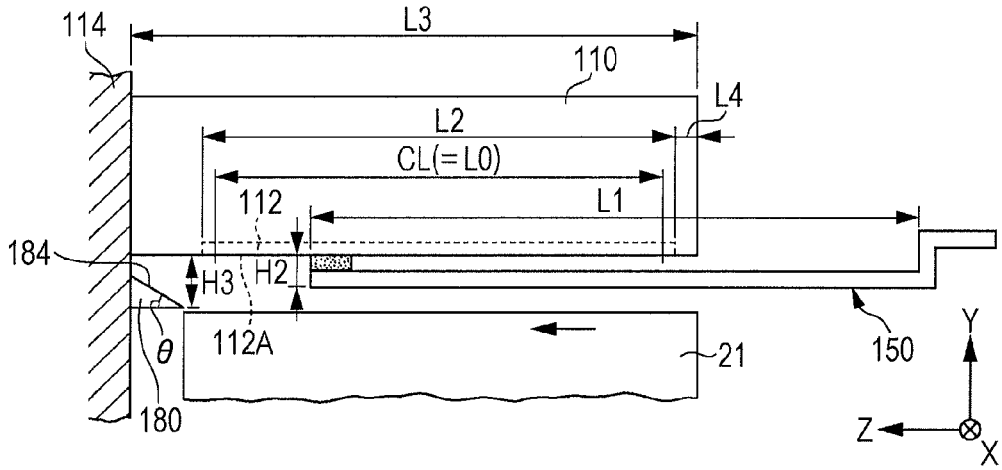
FIGS. 4A to 4C are schematic diagrams illustrating operation of the cleaning device of the first exemplary embodiment.

Cleaning devices 140 are configured to remove substances such as toner T, dust, and paper dust that are attached to surfaces 112A of the transmission glasses 112 of the corresponding exposure devices 23 on the side of the photoconductor drums 21 (see FIG. 4A). Note that each of the cleaning devices 140 is a principal portion of the first exemplary embodiment and thus will be described later. Note that the surface 112A of each of the transmission glasses 112 is a plane.

(Developing Device)

Developing devices 24 are configured to form toner images on the outer circumferential surfaces of the corresponding photoconductor drums 21 by developing electrostatic latent images, which have been formed on the outer circumferential surfaces of the photoconductor drums 21, as toner images with a developer G, which includes the toner T and a carrier CA. The developing devices 24 are connected to toner cartridges 39, which are used for replenishing the corresponding developing devices 24 with the toner T, via replenishment paths (not illustrated). The toner cartridges 39 for different colors are arranged next to one another in the apparatus width direction above the photoconductor drums 21 and the exposure devices 23 as seen from the front and are individually replaceable.

(Transfer Device)

In the transfer device 30, toner images of the photoconductor drums 21 for the corresponding colors are superposed with one another and transferred onto the transfer belt 31 in a first transfer process, and the toner images, which have been superposed with one another, are transferred onto the medium P in a second transfer process.

More specifically, the transfer belt 31 has an endless loop shape and is wound around rollers 32, so that the arrangement thereof is fixed. In the first exemplary embodiment, the transfer belt 31 is arranged in an inverted obtuse triangular shape that has a long side in the apparatus width direction as seen from the front. A roller 32D among the rollers 32 functions as a driving roller that causes the transfer belt 31 to circulate in the direction of arrow A through the power of a motor (not illustrated). A roller 32T among the rollers 32 functions as a tension-applying roller that exerts a tension on the transfer belt 31. A roller 32B among the rollers 32 functions as a counter roller that faces a second transfer roller 34.

An upper side portion of the transfer belt 31 having the above-described posture that extends in the apparatus width direction is in contact with the photoconductor drums 21 for the corresponding colors from below, and toner images of the photoconductor drums 21 are transferred onto the transfer belt 31 as a result of receiving a transfer bias voltage that is applied from first transfer rollers 33. In addition, a top portion of the transfer belt 31 on a lower end side that forms an obtuse angle is in contact with the second transfer roller 34 in such a manner as to define the transfer nip NT, and the toner images are transferred onto the medium P, which passes through the transfer nip NT, as a result of receiving a transfer bias voltage that is applied from the second transfer roller 34.

(Fixing Device)

In the fixing device 40, the toner images, which have been transferred to the medium P in the transfer device 30, are fixed onto the medium P. In the first exemplary embodiment, the fixing device 40 has a configuration in which toner images are heated and applied with pressure at a fixing nip NF, so that the toner images are fixed onto the medium P.

[Medium Transport Unit]

The medium transport unit 50 includes a medium feed unit 52 that feeds the medium P to the image forming unit 12 and a medium ejecting unit 54 that ejects the medium P on which an image has been formed. In addition, the medium transport unit 50 includes a medium returning unit 56 that is used when an image is to be formed on the two surfaces of the medium P and an intermediate transport unit 58 that transports the medium P from the transfer device 30 to the fixing device 40.

The medium feed unit 52 is configured to feed multiple media P one by one to the transfer nip NT of the image forming unit 12 in accordance with the timing of transferring toner images. The medium ejecting unit 54 is configured to eject the medium P, on which an image that is formed of toner images which have been fixed in place is formed in the fixing device 40, to outside the image forming apparatus 10. In the case where an image is to be formed on one surface of the medium P that has the other one surface to which toner images have been fixed, the medium returning unit 56 is configured to return the medium P to the image forming unit 12 (the medium feed unit 52) by reversing the front and rear surfaces of the medium P.

[Subsequent Processing Unit]

The subsequent processing unit 60 includes a medium cooling unit 62 that cools the medium P on which an image has been formed in the image forming unit 12, a correction device 64 that corrects the curvature of the medium P, and an image inspection unit 66 that inspects the image that has been formed on the medium P. These units that are included in the subsequent processing unit 60 are disposed in the medium ejecting unit 54 of the medium transport unit 50.

The medium cooling unit 62, the correction device 64, and the image inspection unit 66, which are included in the subsequent processing unit 60, are disposed in the medium ejecting unit 54 in this order starting from an upstream side in a direction in which the medium P is to be discharged and are configured to perform the above-mentioned subsequent operations on the medium P that is being discharged by the medium ejecting unit 54.

<Operation of Image Forming Apparatus>

Overviews of an image forming process and a subsequent operation process that are to be performed on the medium P by the image forming apparatus 10 will be described.

The controller 70 that is received an image formation command causes the toner image forming units 20, the transfer device 30, and the fixing device 40 to operate. As a result, the photoconductor drums 21 and a developing roller 242 are made to rotate, and the transfer belt 31 is made to circulate. In addition, a pressure roller 42 is made to rotate, and a fixing belt 411 is made to circulate. Furthermore, the controller 70 causes the medium transport unit 50 and the like to operate synchronously with these operations.

Accordingly, the photoconductor drums 21 for the corresponding colors are charged by the corresponding chargers 22 while the photoconductor drums 21 are rotating. In addition, the controller 70 sends image data, which has undergone image processing in the image signal processing unit, to the exposure devices 23. The exposure devices 23 emit the exposure light beams L and irradiate the corresponding photoconductor drums 21, which have been charged, in accordance with the image data. Then, electrostatic latent images are formed on the outer circumferential surfaces of the photoconductor drums 21. The electrostatic latent images, which have been formed on the photoconductor drums 21, are developed into toner images with the developer G that is supplied from the corresponding developing devices 24. As a result, toner images of yellow (Y), magenta (M), cyan (C), and black (K) colors are formed on the photoconductor drums 21 for the corresponding colors.

A transfer bias voltage is applied to the toner images of different colors, which have been formed on the photoconductor drums 21 for the corresponding colors, via the first transfer rollers 33 for the corresponding colors, so that the toner images are sequentially transferred onto the transfer belt 31, which circulates. Accordingly, a toner image that is formed of the toner images of the four colors, which are superposed with one another, is formed on the transfer belt 31. This toner image is transported to the transfer nip NT by circulation of the transfer belt 31. The medium P is fed to the transfer nip NT by the medium feed unit 52 in accordance with the timing of transportation of the toner image. A transfer bias voltage is applied at the transfer nip NT, so that the toner image is transferred onto the medium P from the transfer belt 31.

The medium P on which the toner image has been transferred is transported from the transfer nip NT of the transfer device 30 to the fixing nip NF of the fixing device 40 by the intermediate transport unit 58 while being drawn in by a negative pressure. The fixing device 40 applies heat and a pressing force (fixing energy) to the medium P, which passes through the fixing nip NF. This allows the toner image, which has been transferred to the medium P, to be fixed onto the medium P.

During the period when the medium P, which has been ejected from the fixing device 40, is being transported to an ejected medium receiving portion, which is positioned outside the image forming apparatus 10, by the medium ejecting unit 54, the subsequent processing unit 60 performs the following operations on the medium P. First, the medium P, which has been heated in a fixing process, is cooled in the medium cooling unit 62. Then, the curvature of the medium P is corrected by the correction device 64. In addition, the presence or absence of problems with the toner image, which has been fixed to the medium P, related to toner concentration, the image, the position of the image, and the like and the degrees of such problems are detected by the image inspection unit 66. Then, the medium P is ejected to the medium ejecting unit 54.

On the other hand, in the case where an image is to be formed on a non-image surface of the medium P on which no image has been formed (in the case of two-sided printing), the controller 70 switches a transport path of the medium P, which has passed through the image inspection unit 66, from the medium ejecting unit 54 to the medium returning unit 56. This allows the medium P to be sent into the medium feed unit 52 with the front and rear surfaces of the medium P reversed. An image is formed (fixed) onto the rear surface of the medium P through a process that is similar to the above-described image forming process, which has been performed on the front surface of the medium P. The medium P is ejected to outside the image forming apparatus 10 by the medium ejecting unit 54 through a process that is similar to the above-described subsequent operation process, which has been performed on the front surface of the medium P after the above-described image forming process.

<Configuration of Principal Portion>

The cleaning devices 140, each of which is the principal portion of the first exemplary embodiment, will now be described with reference to FIG. 2A to FIG. 4C. As illustrated in FIG. 4A, each of the cleaning devices 140 includes a cleaning member 150 and an inclined member 180. The cleaning member 150 is a member having an elongated shape or a substantially elongated shape and is arranged in such a manner that the longitudinal direction thereof is parallel to the longitudinal direction of the corresponding transmission glass 112. Here, each of the inclined members 180 is an example of a wall portion.

[Cleaning Member]

As illustrated in FIGS. 3A and 3B, each of the cleaning members 150 includes a flat (plate-shaped) support portion 152 having an elongated shape or a substantially elongated shape, a holding portion 154, and a cleaning portion 156. The holding portion 154 is formed integrally with the support portion 152 on one end side of the corresponding support portion 152.

As illustrated in FIG. 3C, the support portion 152 has an H shape as seen from the apparatus depth direction. The support portion 152 is formed of a body 1521 having a thin-plate-like shape and side wall portions 1522 that are disposed at the ends of the body 1521 in the apparatus width direction in such a manner as to face each other with the body 1521 sandwiched therebetween, the body 1521 and the side wall portions 1522 being formed integrally with one another. Note that the body 1521 is disposed at a position halfway along each of the two side wall portions 1522 in the apparatus height direction.

As illustrated in FIG. 4A, a distance L1 from an end of the support portion 152 on the side of the holding portion 154 to an end of the cleaning portion 156 on the side opposite to that on which the support portion 152 is disposed in the longitudinal direction of the cleaning member 150 is set to be larger than the distance L3 from one end of the corresponding container 110 to the other end of the container 110 in the apparatus depth direction. Here, the cleaning portion 156 is an example of an end portion of the support portion 152.

As illustrated in FIG. 3B, the cleaning portion 156 includes a base portion 158 having a plate-like shape, an elastic portion 160, and a wiping portion 162. Note that the support portion 152, the holding portion 154, and the base portion 158 are integrally formed into one product that is formed of resin.

As illustrated in FIG. 3B, the base portion 158 includes a base portion 166 having a rectangular shape, two projecting portions 168, and a fixing portion 164 having a rectangular shape. The two projecting portions 168 project from the base portion 166 toward different sides in the lateral direction of the cleaning member 150 and are formed integrally with the base portion 166. The fixing portion 164 projects upward (upward in the apparatus height direction) from the base portion 166 and is formed integrally with the base portion 166. Note that in the case where a cleaning operation is performed by the cleaning portion 156, the two projecting portions 168 are to be inserted into an area between a rib 124 and a rib 132, which are formed in the container 110 and which will be described later.

The elastic portion 160 is a member having a rectangular parallelepiped shape that is made of a sponge material (an elastic material). In addition, the elastic portion 160 is formed in a rectangular shape as seen from the apparatus height direction and fixed to an upper surface of the fixing portion 164 in the apparatus height direction.

The wiping portion 162 is a member having a rectangular parallelepiped shape that is made of a piece of nonwoven fabric. In addition, the wiping portion 162 is formed in a rectangular shape as seen from the apparatus height direction and fixed to an upper surface of the elastic portion 160 in the apparatus height direction.

The distance from a lower surface of the cleaning portion 156 (a surface of the base portion 166 on the side opposite to that on which the corresponding transmission glass 112 is disposed) to an upper surface of the cleaning portion 156 (a surface of the wiping portion 162 that makes contact with the transmission glass 112) in the apparatus height direction is a distance H1.

The cleaning member 150 is configured to clean the surface 112A of the corresponding transmission glass 112 by moving the support portion 152 in the longitudinal direction of the transmission glass 112 in a state where the cleaning portion 156 is in contact with the surface 112A of the transmission glass 112 (see FIG. 4A). The two projecting portions 168 of the cleaning member 150 are to be inserted into an area between the ribs 124 and 132, which are formed in the corresponding container 110 on the proximal side in the apparatus depth direction, and are movable along a guide rail (not illustrated) that is arranged in a lower portion of the container 110 in the apparatus height direction. The above-described guide rail is formed in such a manner as to be straight along the apparatus depth direction. Here, the side of the cleaning member 150 that faces the surface 112A of the transmission glass 112 is the side on which the cleaning portion 156 performs a cleaning operation.

When the two projecting portions 168 move along the above-described guide rail, the support portion 152 moves in a state where the elastic portion 160 is compressed between the base portion 158 and the surface 112A of the transmission glass 112 (or the wiping portion 162). The movement of the support portion 152 is not illustrated. In this case, the distance from the lower surface of the cleaning portion 156 to the upper surface of the cleaning portion 156 in the apparatus height direction is a distance H2 (see FIG. 4A).

[Inclined Member]

Figure 4B:
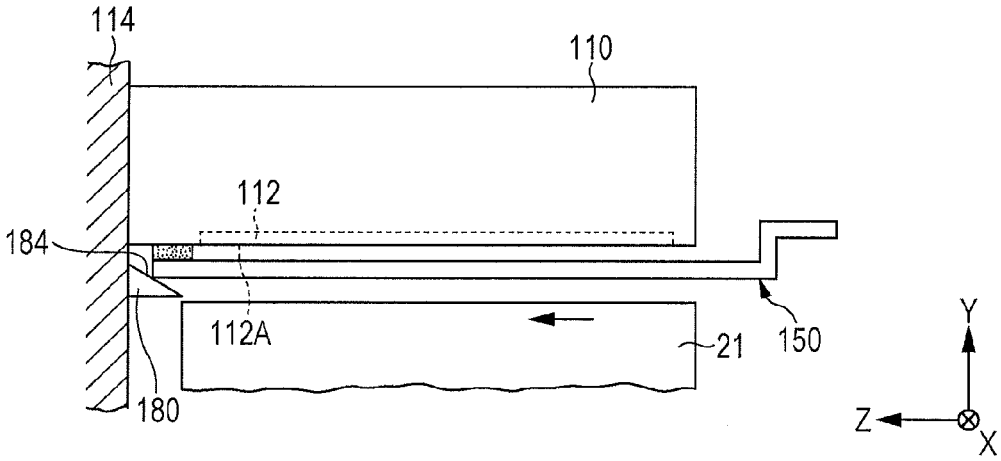
Figure 4C:
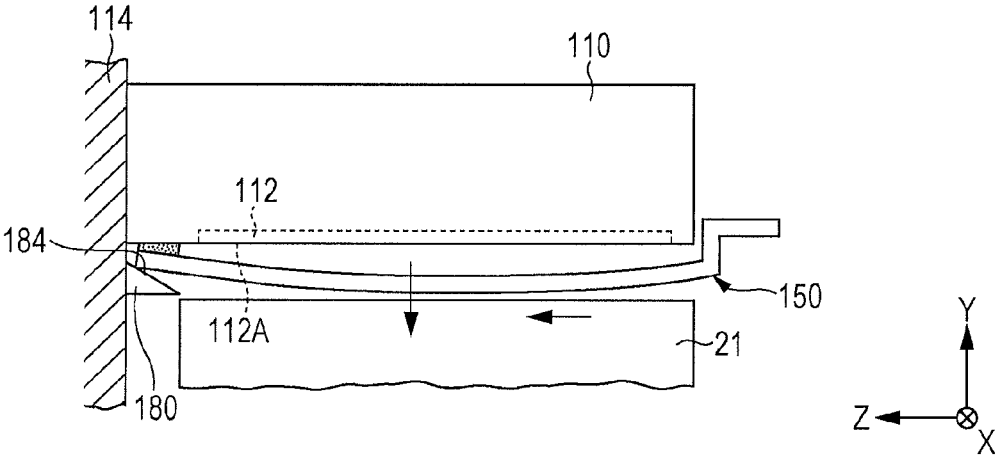

The inclined member 180 will now be described with reference to FIGS. 4A to 4C. As illustrated in FIGS. 4A to 4C, the inclined member 180 is fixed to a housing 114 that is included in the image forming apparatus 10. The inclined member 180 is disposed at a position further toward the distal side in the apparatus depth direction than the transmission glass 112, which is fixed to the container 110. In addition, the inclined member 180 has an inclined surface 184 that guides the cleaning portion 156 toward the side of the transmission glass 112 as the cleaning portion 156 moves toward the distal side in the apparatus depth direction. In the first exemplary embodiment, the inclined surface 184 is a plane that is inclined at an angle θ of 30 degrees with respect to the apparatus depth direction. In other words, the inclined member 180 is disposed on one end side of the transmission glass 112 in the longitudinal direction of the transmission glass 112. The inclined surface 184 of the inclined member 180 is formed along a direction that intersects the longitudinal direction of the transmission glass 112. Note that the inclined member 180 is made of a metal.

The distance between a proximal end of the inclined member 180 in the apparatus depth direction and the surface 112A of the transmission glass 112 in the apparatus height direction is a distance H3. The distance H3 is set to be larger than the distance H2 (see FIG. 4A).

[Relationship Between Cleaning Member and Inclined Member]

Figure 2A:
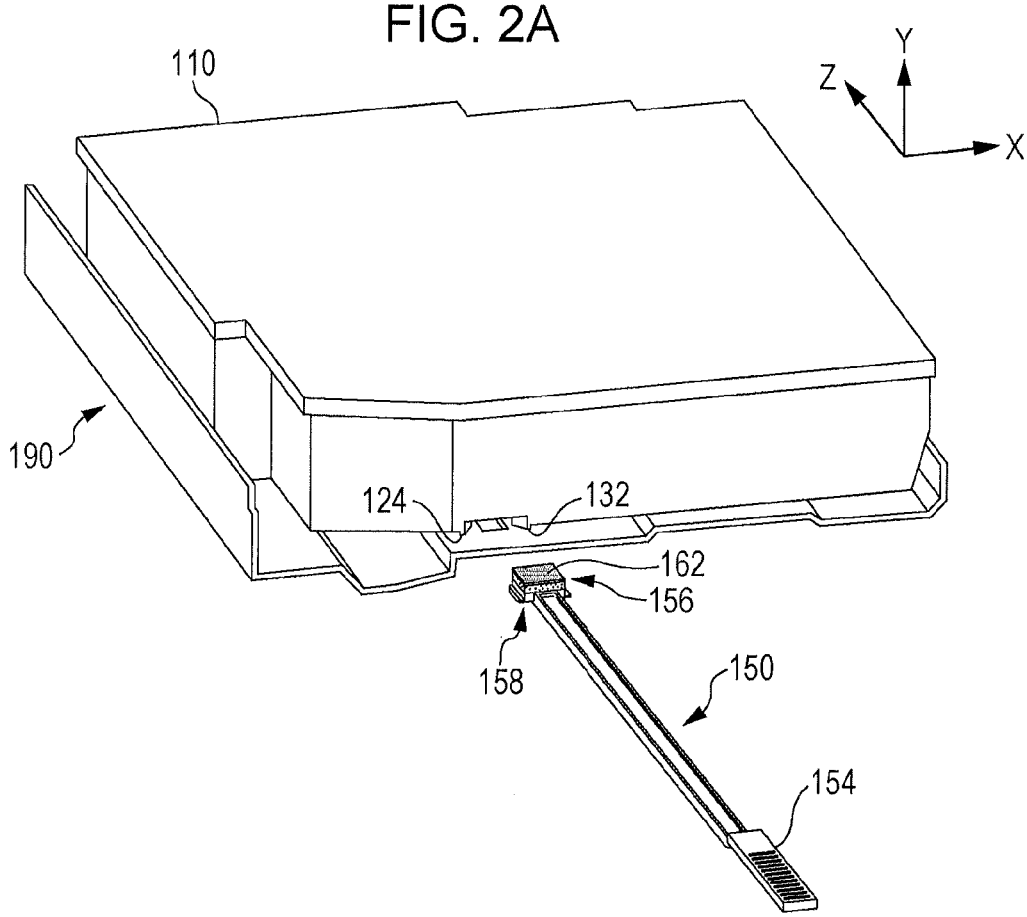
FIGS. 2A and 2B are perspective views illustrating a container, a cleaning member, and the peripheral portions of the first exemplary embodiment.
Figure 2B:
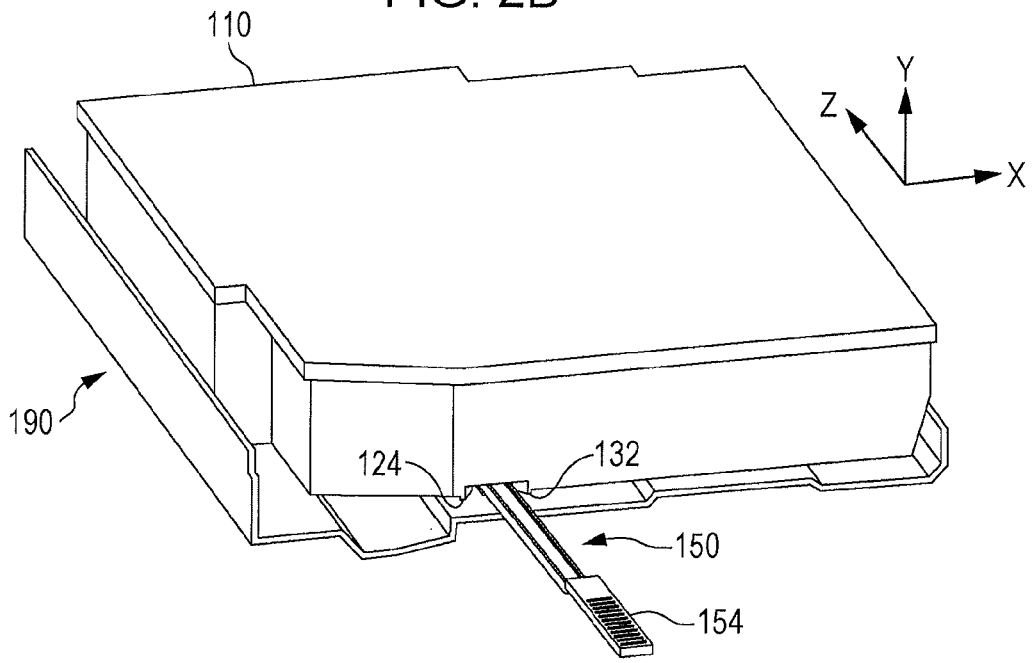

When a cleaning operation is performed, the cleaning portion 156 is inserted into an area between the rib 124 and the rib 132, which are formed in the container 110 (see FIGS. 2A and 2B). The position of the cleaning portion 156 in the apparatus width direction and in the apparatus height direction is limited by the above-described guide rail, which is connected to the ribs 124 and 132, at a position further toward the distal side in the apparatus depth direction than the ribs 124 and 132, and the cleaning portion 156 is to be guided toward the distal side in the apparatus depth direction. During this period of time, since the elastic portion 160 is compressed, the wiping portion 162 moves in a state of being pressed against the surface 112A of the transmission glass 112 (see FIG. 4A). When the cleaning portion 156 (the wiping portion 162) passes through a distal end of the cleaning area CL in the apparatus depth direction, a portion of the cleaning portion 156 (the base portion 166) on the side opposite to that on which the transmission glass 112 is disposed runs onto the inclined surface 184. When the cleaning portion 156 (an end of the cleaning portion 156) that has made contact with the inclined surface 184 is further pressed toward the distal side in the apparatus depth direction and inserted, the cleaning portion 156 (the end of the cleaning portion 156) is guided toward the side of the transmission glass 112 while moving along the inclined surface 184 toward the distal side in the apparatus depth direction.

[Device to be Cleaned]

A combination of the above-described transmission glass 112 and the above-described inclined member 180 is an example of a device to be cleaned.

Effects of First Exemplary Embodiment

Effects of the first exemplary embodiment will be described below.

First, assume Comparative Example 1 (not illustrated) is a comparative example of the cleaning device 140 of the first exemplary embodiment. In Comparative Example 1, a difference from one of the cleaning devices 140 of the first exemplary embodiment is that a cleaning device of Comparative Example 1 includes a wall portion, which is formed along the apparatus height direction, instead of the inclined member 180.

In Comparative Example 1, when a cleaning portion of a cleaning member makes contact with the above-described wall portion, and a support portion of the cleaning portion is pressed toward the distal side in the apparatus depth direction, the support portion is bent in a convex manner toward one side in the apparatus height direction. There is a possibility of a portion of the support portion, which has been bent in a convex manner toward the side of a transmission glass, making contact with a surface of the transmission glass and forming scratches on the surface of the transmission glass.

In the case where such scratches are formed on the surface of the transmission glass due to this configuration, part of an exposure light beam L that penetrates the transmission glass may be scattered due to the scratches, and a light exposure failure may occur during an image forming operation.

In contrast, the cleaning device 140 of the first exemplary embodiment will be described with reference to FIGS. 4A to 4C. When a cleaning operation is performed, the two projecting portions 168 that have been received in an area between the rib 124 and the rib 132 of the container 110 are guided along the above-described guide rail toward the distal side in the apparatus depth direction (see FIG. 4A). In addition, when the cleaning portion 156 (the wiping portion 162) passes through the distal end of the cleaning area CL in the apparatus depth direction, the portion of the cleaning portion 156 (the base portion 166) on the side opposite to that on which the transmission glass 112 is disposed runs onto the inclined surface 184 of the inclined member 180 (see FIG. 4B). Then, the cleaning portion 156 is guided toward the side of the transmission glass 112 while moving along the inclined surface 184 toward the distal side in the apparatus depth direction (see FIG. 4C). As a result, the support portion 152 is bent in a convex manner toward the side opposite to that on which the transmission glass 112 is disposed (toward the side of the photoconductor drum 21).

In the image forming apparatus 10 that includes the cleaning devices 140 of the first exemplary embodiment, formation of scratches on the surfaces 112A of the transmission glasses 112 that occurs along with a cleaning operation of the surfaces 112A of the transmission glasses 112 is suppressed, and thus, it is not likely that the exposure light beams L will be scattered.

Therefore, according to the image forming apparatus 10 of the first exemplary embodiment, occurrence of an image formation failure due to scratches on the surfaces 112A of the transmission glasses 112 that are formed along with a cleaning operation of the surfaces 112A of the transmission glasses 112 is suppressed as compared with the case of the image forming apparatus that includes the cleaning device of Comparative Example 1.

Modification of First Exemplary Embodiment (Modifications 1 to 3)

Modifications of the first exemplary embodiment will now be described with reference to FIG. 5 to FIG. 7. Differences from the above-described first exemplary embodiment will be described below. Note that, in the following description, in the case where the components that have been used in the above-described first exemplary embodiment are used, the reference numerals of the components will be used as they are.

<Configuration of Modification 1>

Figure 5:
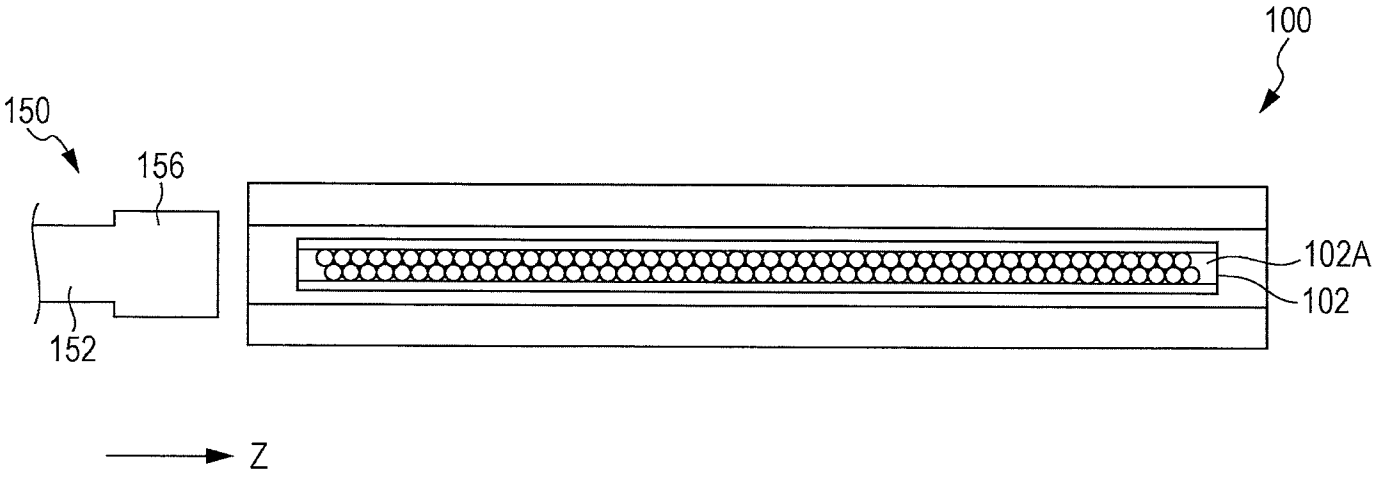
FIG. 5 is a plan view of an LED head that is included in an image forming apparatus according to a modification (Modification 1) of the first exemplary embodiment.

As illustrated in FIG. 5, in Modification 1, a cleaning device 140 is configured to clean a light radiation surface 102A of a lens array 102 of an LED head 100. The LED head 100 includes multiple LED elements (not illustrated) that emit an exposure light beam L. In this case, a support portion 152 of a cleaning member 150 is configured to support a cleaning portion 156 in such a manner that the cleaning portion 156 makes contact with the light radiation surface 102A of the lens array 102. The support portion 152 is configured to move in the longitudinal direction of the light radiation surface 102A (the Z direction in FIG. 5). Here, each of the above-mentioned LED elements is an example of a light source. The lens array 102 is an example of a light transmission member. The light radiation surface 102A is an example of a surface of a light transmission member. The LED head 100 is an example of a light radiation device.

<Effects of Modification 1>

Effects of Modification 1 are similar to those of the above-described first exemplary embodiment.

<Configuration of Modification 2>

Figure 6:
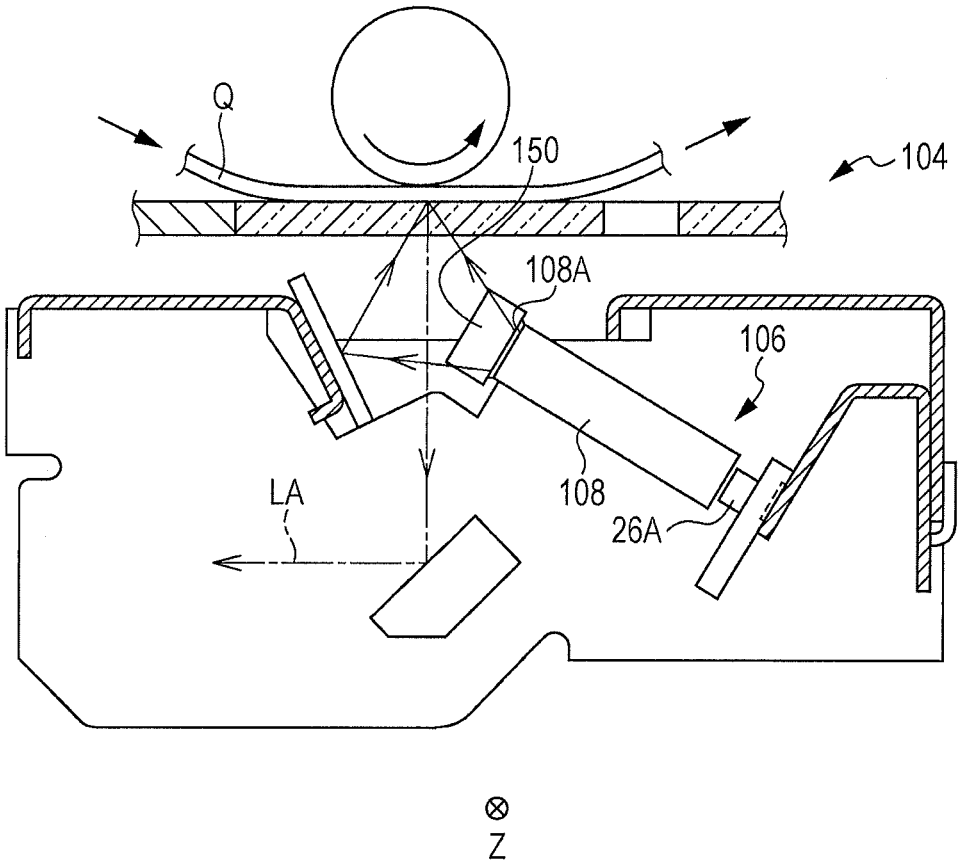
FIG. 6 is a schematic diagram of a scanner device that is included in an image forming apparatus according to a modification (Modification 2) of the first exemplary embodiment.

As illustrated in FIG. 6, in Modification 2, a cleaning device 140 is configured to clean a light transmission surface 108A of a light guide plate 108 of a light transmission member 106 that is included in a scanner device 104. An image forming apparatus 10 of Modification 2 includes the scanner device 104. In the image forming apparatus 10, the scanner device 104 is configured to send an image formation command to a controller 70 on the basis of information that is read by the scanner device 104. A light transmission member 106 transmits light that is emitted from an LED element 26A. The light that has been emitted from the LED element 26A and has penetrated the light guide plate 108 is to be radiated onto a document to be read Q. In this case, a support portion 152 of a cleaning member 150 is configured to support a cleaning portion 156 in such a manner that the cleaning portion 156 makes contact with the light transmission surface 108A. The support portion 152 is configured to move in the longitudinal direction of the light transmission surface 108A (the Z direction in FIG. 6). Here, the LED element 26A is an example of a light source. The light guide plate 108 is an example of a light transmission member. The light transmission surface 108A is an example of a surface of a light transmission member. The document to be read Q is an example of a member to be light-irradiated. The scanner device 104 or the light transmission member 106 is an example of a light radiation device.

<Effects of Modification 2>

According to Modification 2, it is not likely that the light that is radiated onto the document to be read Q will be scattered due to scratches that are formed on the light transmission surface 108A of the light guide plate 108.

Therefore, according to the scanner device 104 of Modification 2, occurrence of a document reading failure due to scratches that are formed on the light transmission surface 108A of the light guide plate 108 is suppressed as compared with the case of a scanner device that includes the cleaning device of Comparative Example 1. In the image forming apparatus 10 that includes the scanner device 104 of Modification 2, occurrence of an image formation failure on the basis of an image formation command that is sent due to such a document reading failure is suppressed.

The rest of the effects of Modification 2 is similar to those of the above-described first exemplary embodiment.

<Configuration of Modification 3>

Figure 7:
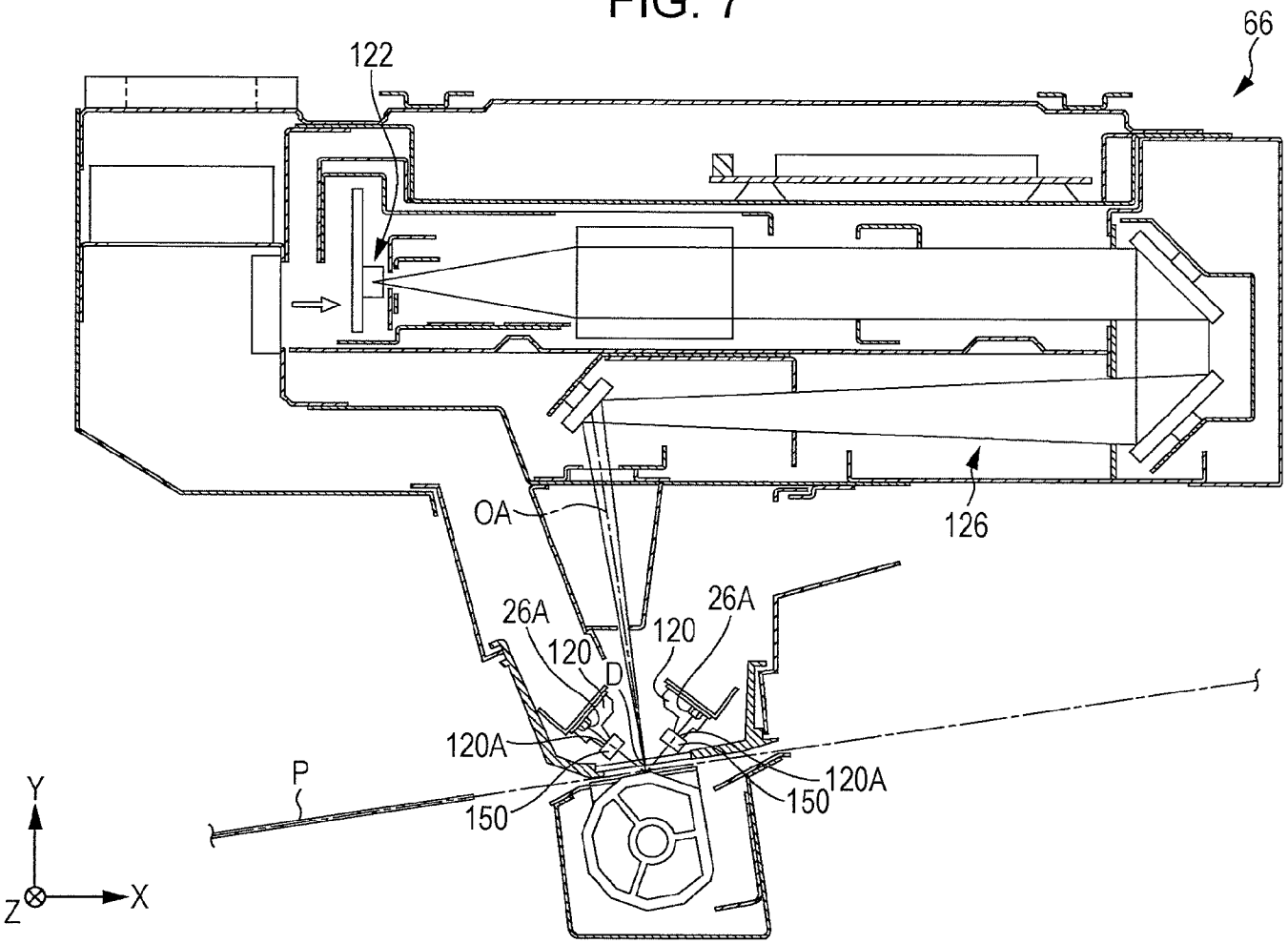
FIG. 7 is a schematic diagram of an image inspection unit that is included in an image forming apparatus according to a modification (Modification 3) of the first exemplary embodiment.

In Modification 3, a cleaning device 140 is configured to clean light transmission surfaces 120A of two light guide members 120 that are included in an image inspection unit 66 (see FIG. 1 and FIG. 7). Each of the light guide members 120 transmits a light beam that is emitted from a corresponding one of LED elements 26A. The light beams that have been emitted from the LED elements 26A and that have penetrated the corresponding light guide members 120 are focused at a passage position D through which the medium P, on which an image has been formed, passes and are radiated onto the medium P. The light beams that have been reflected at the passage position D are focused onto a charge coupled device (CCD) sensor 122 by an imaging optical system 126 that is included in the image inspection unit 66.

The CCD sensor 122 is configured to output a signal according to the image density at each position in an image that is formed on the medium P to a controller 70. The controller 70 is configured to control the above-described units on the basis of a signal, which is output from the CCD sensor 122, in such a manner as to correct image density, image formation position, and the like.

Support portions 152 of cleaning members 150 are configured to support cleaning portions 156 in such a manner that the cleaning portions 156 make contact with the corresponding light radiation surfaces 120A. The support portions 152 are configured to move in the longitudinal direction of the light radiation surfaces 120A (the Z direction in FIG. 7). Here, each of the light guide members 120 is an example of a light transmission member. Each of the light transmission surfaces 120A is an example of a surface of a light transmission member. The image inspection unit 66 is an example of a light radiation device.

<Effects of Modification 3>

Here, assume the case where the cleaning device of Comparative Example 1 is provided as a cleaning device for each of the light guide members 120. In this case, in the case where scratches are formed on the light transmission surfaces 120A of the light guide members 120, the light beams, which are radiated onto the medium P, may be unevenly radiated onto the medium P in the apparatus depth direction. In such a case, the image density at each position in an image that is formed on the medium P is not reflected in the light beams, which are to be focused onto the CCD sensor 122 by the imaging optical system 126. Since the controller 70 controls the above-described units on the basis of a signal, which is output from the CCD sensor 122, there is a possibility of inadequate corrections of image density, image formation position, and the like being made.

On the other hand, in the image forming apparatus 10 that includes the image inspection unit 66 of Modification 3, formation of scratches on the light transmission surfaces 120A of the light guide members 120 along with a cleaning operation of the light transmission surfaces 120A of the light guide members 120 is suppressed, and thus, such inadequate corrections caused by the control that is performed by the controller 70 on the basis of a signal, which is output from the CCD sensor 122, is suppressed.

Therefore, according the image forming apparatus 10 that includes the image inspection unit 66 of Modification 3, occurrence of an image formation failure due to scratches on the light transmission surfaces 120A of the light guide members 120 that are formed along with a cleaning operation of the light transmission surfaces 120A of the light guide members 120 is suppressed as compared with the case of the image forming apparatus that includes an image inspection unit that includes the cleaning device of Comparative Example 1.

The effects of Modification 3 are similar to those of the above-described first exemplary embodiment.

Second Exemplary Embodiment

Configuration of Second Exemplary Embodiment

The configuration of a cleaning device 140A of a second exemplary embodiment will now be described with reference to FIGS. 8A to 8C. Differences from the above-described first exemplary embodiment will be described below. Note that, in the following description, in the case where the components that have been used in the above-described first exemplary embodiment are used, the reference numerals of the components will be used as they are.

Figure 8A:
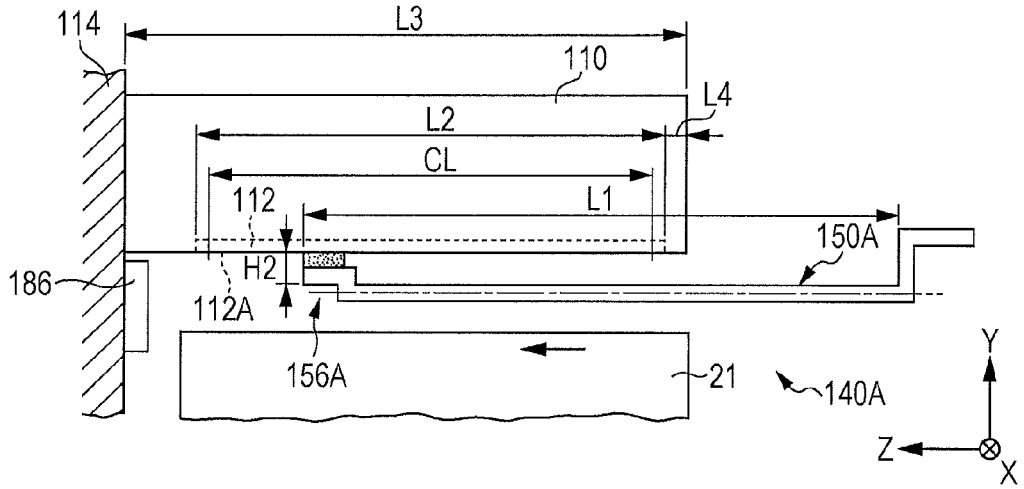
FIGS. 8A to 8C are schematic diagrams illustrating operation of a cleaning device of a second exemplary embodiment.
Figure 8B:
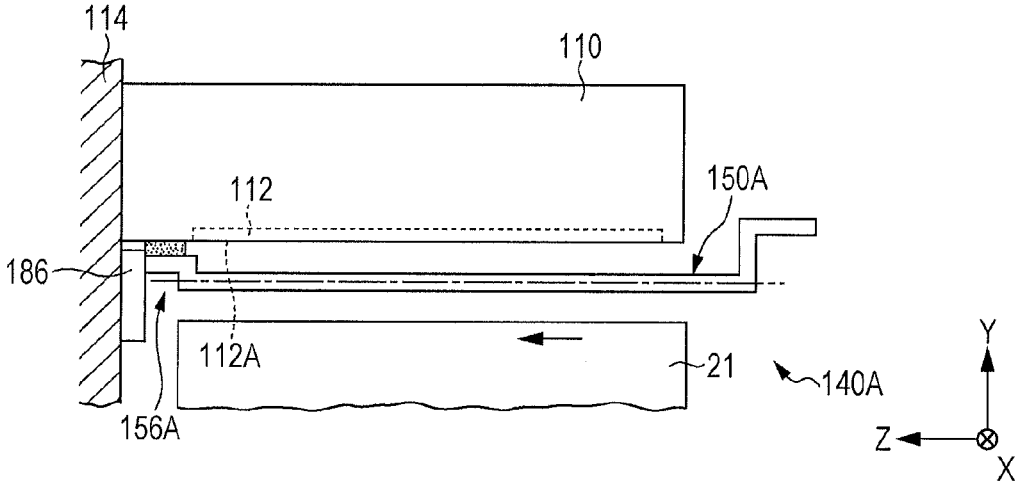
Figure 8C:
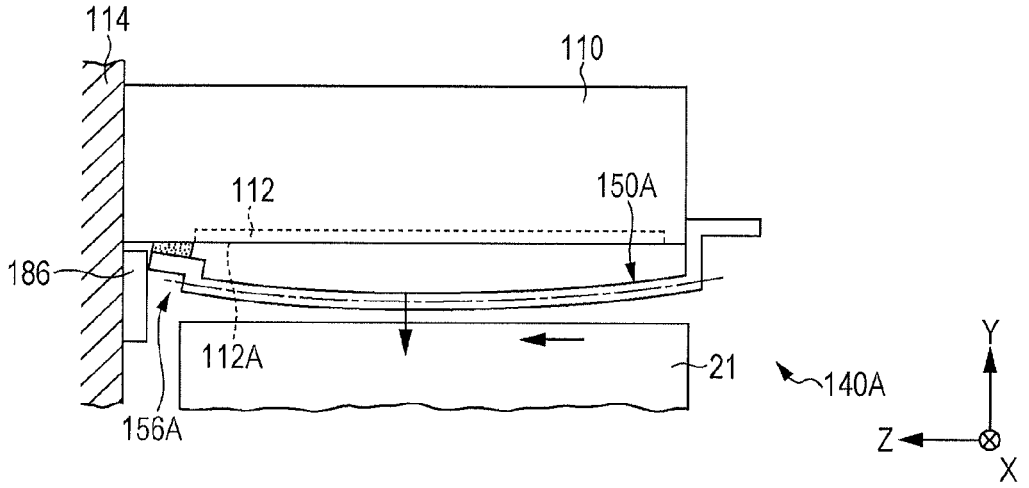

A support portion 152 of a cleaning member 150A that is included in the cleaning device 140A is formed in such a manner that a portion of a lower surface of a base portion 166 of a cleaning portion 156A in the apparatus height direction and an end portion of the support portion 152 that is positioned on the upper side in the apparatus height direction and on the distal side in the apparatus depth direction are integrally formed (see FIG. 8A). In addition, the cleaning device 140A includes a plate-shaped member 186 that is formed along the apparatus height direction. Here, the plate-shaped member 186 is an example of a wall portion.

Note that the cleaning portion 156A of the cleaning member 150A is formed integrally with the support portion 152 in such a manner as to be positioned at an end side of the support portion 152 and positioned between the neutral axis (a one dot chain line in FIG. 8A) of the support portion 152 and a transmission glass 112. When the cleaning portion 156A passes through a cleaning area CL, the cleaning portion 156A makes contact with the plate-shaped member 186. Here, the cleaning portion 156A is an example of a projecting portion that makes contact with the plate-shaped member 186.

Note that the neutral axis (a one dot chain line in each of FIGS. 8A to 8C) of the support portion 152 is a line (a plane) that connects portions of the support portion 152 that will not receive a compressive stress and a tensile stress (a load) in the case where a bending moment in the apparatus depth direction is generated in the support portion 152.

Effects of Second Exemplary Embodiment

Effects of the cleaning device 140A of the second exemplary embodiment will now be described with reference to FIGS. 8A to 8C. When the cleaning portion 156A (a wiping portion 162) passes through the cleaning area CL, a portion of the cleaning portion 156A (the base portion 166) on the distal side in the apparatus depth direction makes contact with the plate-shaped member 186 (see FIG. 8B). When the cleaning portion 156A, which has made contact with the plate-shaped member 186, is pressed toward the distal side in the apparatus depth direction, the cleaning portion 156A is pressed between the neutral axis of the support portion 152 and the transmission glass 112, so that a bending moment is generated in the support portion 152. As a result, the support portion 152 is bent in a convex manner toward the side opposite to that on which the transmission glass 112 is disposed (see FIG. 8C).

Modification of Second Exemplary Embodiment

Configuration of Modification of Second Exemplary Embodiment

Figure 9:
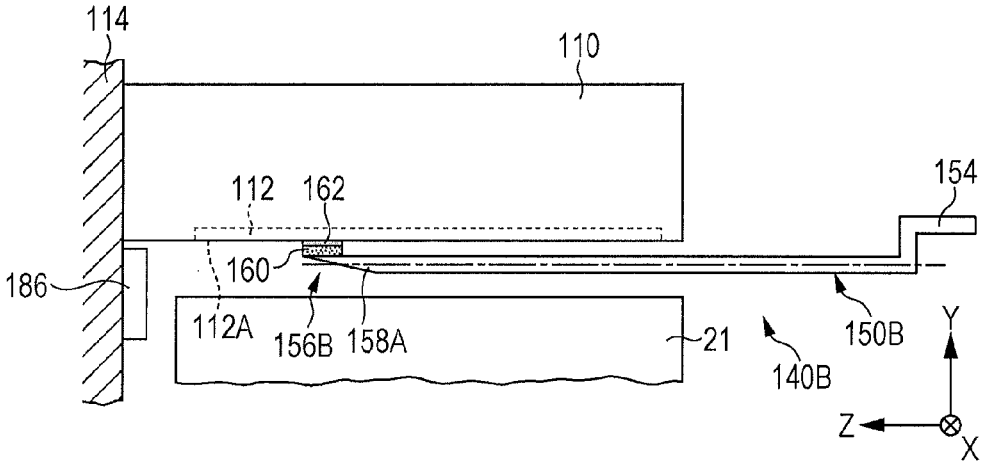
FIG. 9 is a schematic diagram illustrating a modification of the cleaning device of the second exemplary embodiment.

A cleaning device 140B of a modification of the second exemplary embodiment will now be described with reference to FIG. 9. Differences from the above-described first and second exemplary embodiments (including the modifications) will be described below. Note that, in the following description, in the case where the components that have been used in the above-described first and second exemplary embodiments are used, the reference numerals of the components will be used as they are.

In a cleaning portion 156B of a cleaning member 150B that is included in the cleaning device 140B, a base portion 158A, which will be described below, is formed integrally with a support portion 152. The base portion 158A has an inclined surface on the side opposite to that on which a transmission glass 112 is disposed, and the inclined surface is formed in such a manner that the distance between the inclined surface and a surface 112A of the transmission glass 112 in the apparatus height direction decreases toward the distal side in the apparatus depth direction. In other words, an end portion (a portion on the distal side in the apparatus depth direction) of the base portion 158A is formed on an end side of the support portion 152 and is formed between the neutral axis (a one dot chain line in FIG. 9) of the support portion 152 and the transmission glass 112. When the cleaning portion 156B of the cleaning member 150B passes through a distal end of a cleaning area CL in the apparatus depth direction at the time of performing a cleaning operation, an end of the base portion 158A makes contact with the plate-shaped member 186. Here, the cleaning portion 156B (the base portion 158A) is an example of a projecting portion. In other words, the base portion 158A is a portion of the cleaning portion 156B.

Effects of Modification of Second Exemplary Embodiment

Effects of Modification 2 are similar to those of the above-described first and second exemplary embodiments.

Third Exemplary Embodiment

Configuration of Third Exemplary Embodiment

Figure 10:
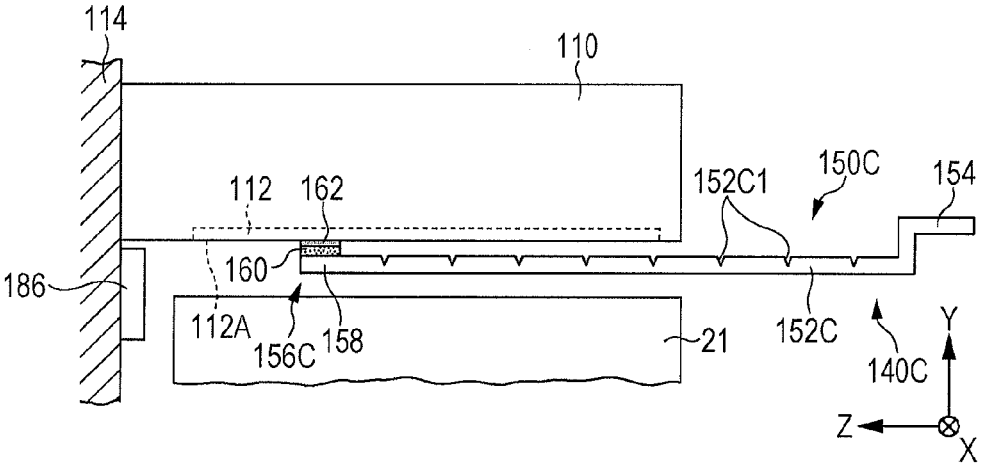
FIG. 10 is a schematic diagram illustrating a cleaning device of a third exemplary embodiment.

A third exemplary embodiment will now be described with reference to FIG. 10. Differences from the above-described first and second exemplary embodiments (including the modifications) will be described below. Note that, in the following description, in the case where the components that have been used in the above-described first and second exemplary embodiments are used, the reference numerals of the components will be used as they are.

In a cleaning device 140C of the third exemplary embodiment, grooves 152C1 are formed in a portion of a support portion 152C of a cleaning member 150C on the side of a transmission glass 112 along the longitudinal direction of a cleaning member 150C (an axial direction of the cleaning member 150C). When the cleaning member 150C is seen from the apparatus width direction, each of the grooves 152C1 are formed in such a manner as to open in a V-shape toward the side of the transmission glass 112. In other words, the density of a portion of the support portion 152C on the side of the transmission glass 112 is smaller than that of a portion of the support portion 152C on the side opposite to that on which the transmission glass 112 is disposed. Here, each of the grooves 152C1 is an example of a recess.

At the time of performing a cleaning operation, when a cleaning portion 156C (a base portion 158) passes through a distal end of a cleaning area CL in the apparatus depth direction, makes contact with a plate-shaped member 186, and is further pressed, a compressive stress is generated in the support portion 152C. In this case, the grooves 152C1, each of which has a V-shape and each of which is formed in the portion of the support portion 152C on the side of the transmission glass 112, are capable of being deformed in such a manner as to be closed. In other words, the support portion 152C is capable of being deformed in a convex manner toward the side opposite to that on which the transmission glass 112 is disposed. Note that the portion of the support portion 152C on the side opposite to that on which the transmission glass 112 is disposed has a bending rigidity higher than that of the portion of the support portion 152C on the side of the transmission glass 112.

Effects of Third Exemplary Embodiment

In the case where a compressive stress is generated in the support portion 152C, the grooves 152C1, each of which has a V-shape and is formed in the portion of the support portion 152C on the side of the transmission glass 112, are deformed in such a manner as to be closed. As a result, the support portion 152C is deformed in a convex manner toward the side opposite to that on which the transmission glass 112 is disposed.

The effects of the third exemplary embodiment are similar to those of the above-described first and second exemplary embodiments.

Fourth Exemplary Embodiment

Configuration of Fourth Exemplary Embodiment

Figure 11:
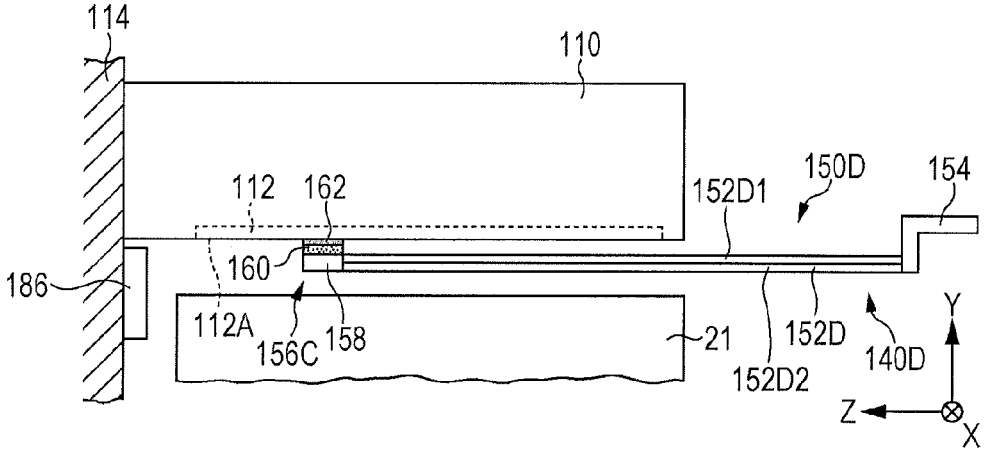
FIG. 11 is a schematic diagram illustrating a cleaning device of a fourth exemplary embodiment.

A fourth exemplary embodiment will now be described with reference to FIG. 11. Differences from the above-described first to third exemplary embodiments (including the modifications) will be described below. Note that, in the following description, in the case where the components that have been used in the above-described first to third exemplary embodiments are used, the reference numerals of the components will be used as they are.

A support portion 152D of a cleaning device 140D of the fourth exemplary embodiment is formed by joining a first support portion 152D1 and a second support portion 152D2 together. The first support portion 152D1 is positioned on the side of a transmission glass 112, and the second support portion 152D2 is positioned on the side opposite to that on which the transmission glass 112 is disposed. The material out of which the first support portion 152D1 is made has a modulus of elasticity lower than that of the material out of which the second support portion 152D2 is made. In other words, in the support portion 152D, the bending rigidity of the second support portion 152D2, which is disposed on the side opposite to that on which the transmission glass 112 is disposed, is higher than that of the first support portion 152D1.

At the time of performing a cleaning operation, when a cleaning portion 156C (a base portion 158) passes through a distal end of a cleaning area CL in the apparatus depth direction, makes contact with a plate-shaped member 186, and is further pressed, a compressive stress is generated in a support portion 152D. Therefore, the support portion 152D is capable of being deformed in a convex manner toward the side opposite to that on which a transmission glass 112 is disposed.

Effects of Fourth Exemplary Embodiment

Effects of the fourth exemplary embodiment are similar to those of the above-described first to third exemplary embodiments.

Modification of Fourth Exemplary Embodiment

Configuration of Modification of Fourth Exemplary Embodiment

Figure 12A:
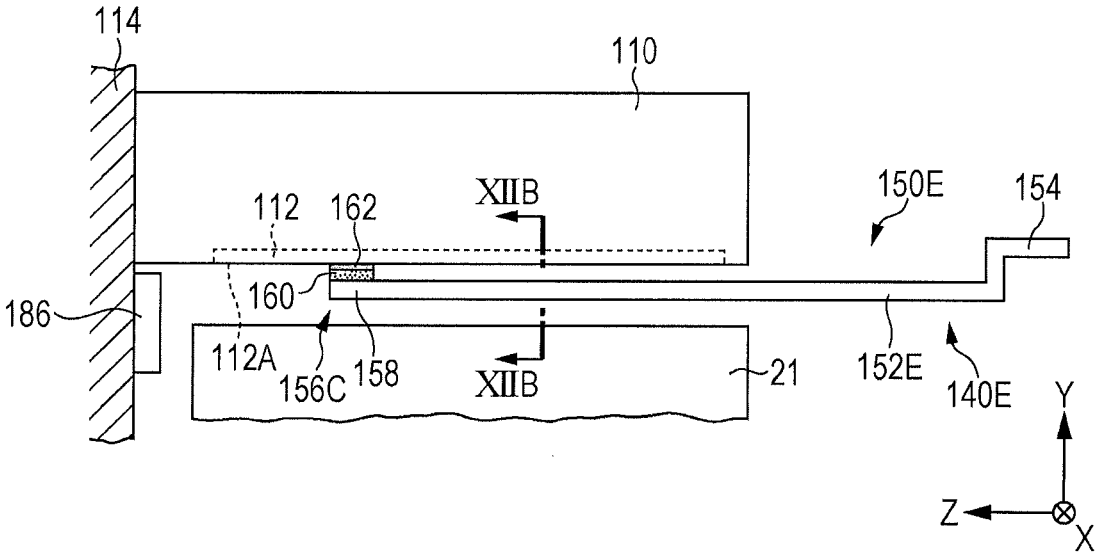
FIGS. 12A and 12B are schematic diagrams illustrating a modification of the cleaning device of the fourth exemplary embodiment.
Figure 12B:
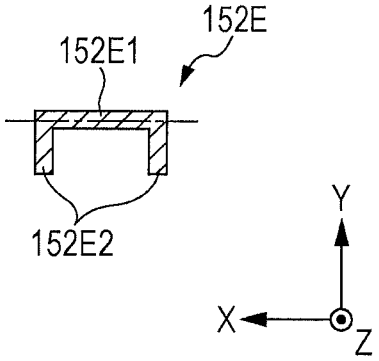

A modification of the fourth exemplary embodiment will now be described with reference to FIGS. 12A and 12B. Differences from the above-described first to fourth exemplary embodiments (including the modifications) will be described below. Note that, in the following description, in the case where the components that have been used in the above-described first to fourth exemplary embodiments are used, the reference numerals of the components will be used as they are.

A support portion 152E of a cleaning device 140E of the modification of the fourth exemplary embodiment is formed in a U shape as seen from the apparatus depth direction. Two side wall portions 152E2 are formed in such a manner as to be positioned further toward the side opposite to that on which a transmission glass 112 is disposed than the central axis (a one dot chain line in FIG. 12B) of a body 152E1 that is included in the support portion 152E as seen from the apparatus depth direction.

At the time of performing a cleaning operation, when a cleaning portion 156C (a base portion 158) passes through a distal end of a cleaning area CL in the apparatus depth direction, makes contact with a plate-shaped member 186, and is further pressed, the side wall portions 152E2 function as reinforcing members for the body 152E1. As a result, the support portion 152E is capable of being deformed in a convex manner toward the side opposite to that on which the transmission glass 112 is disposed. In other words, a portion of the support portion 152E that is positioned further toward the side opposite to that on which the transmission glass 112 is disposed than the above-mentioned central axis (see FIG. 12B) has a high bending rigidity.

Effects of Modification of Fourth Exemplary Embodiment

Effects of the modification of the fourth exemplary embodiment are similar to those of the above-described first to fourth exemplary embodiments.

Reference Example

A reference example will now be described with reference to FIGS. 13A to 13C. Similarly to as in the above-described first to fourth exemplary embodiments, a cleaning device 140F according to the reference example, which will be described below, has a configuration in which a support portion 152F does not make contact with a surface 112A of a transmission glass 112, so that scratches will not be formed on the surface 112A.

However, a specific configuration of the cleaning device 140F is different from those of the above-described first to fourth exemplary embodiments. Regarding the cleaning device 140F, differences from the above-described first to fourth exemplary embodiments (including the modifications) will be described below. Note that, in the following description, in the case where the components that have been used in the above-described first to fourth exemplary embodiments are used, the reference numerals of the components will be used as they are.

Configuration of Reference Example

The cleaning device 140F includes a cleaning member 150F, which will be described below. Unlike the above-described first to fourth exemplary embodiments (including the modifications), the cleaning device 140F does not include the inclined member 180 and the plate-shaped member 186 (see FIG. 13A).

In the cleaning member 150F, the distance from an end of the support portion 152F on the side of a holding portion 154 to an end of a cleaning portion 156 on the side opposite to that on which the support portion 152 is disposed in the longitudinal direction of the cleaning member 150F is a distance L5. The distance L5 is set to be smaller than the length (L3) from the proximal end of a container 110 in the apparatus depth direction to the distal end of the container 110 in the apparatus depth direction (see FIGS. 13B and 13C). With this configuration, when a cleaning operation is performed, the holding portion 154 makes contact with a side wall (with no reference numeral) of the container 110 on the proximal side in the apparatus depth direction, and thus, the cleaning portion 156 does not make contact with a housing 182, which will be described below. Here, the cleaning portion 156 is an example of an end portion of the support portion 152.

Figure 13A:
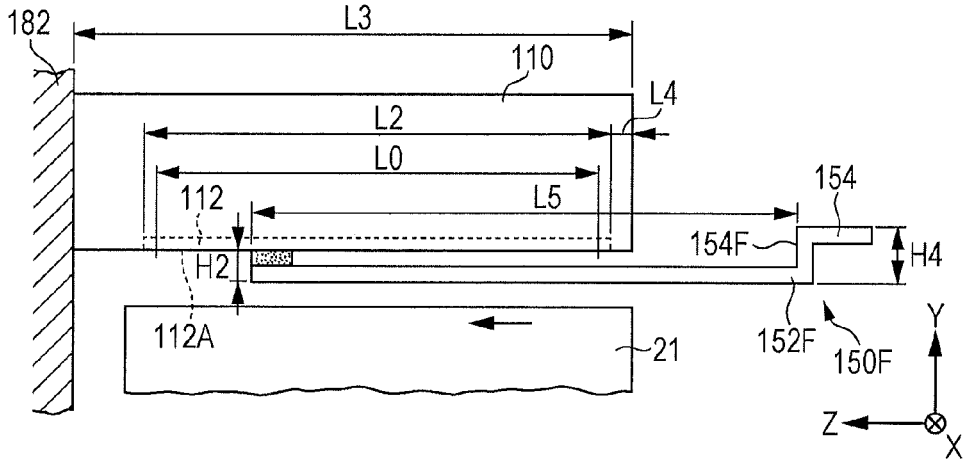
FIGS. 13A to 13C are schematic diagrams illustrating operation of a cleaning device of a reference example.
Figure 13B:
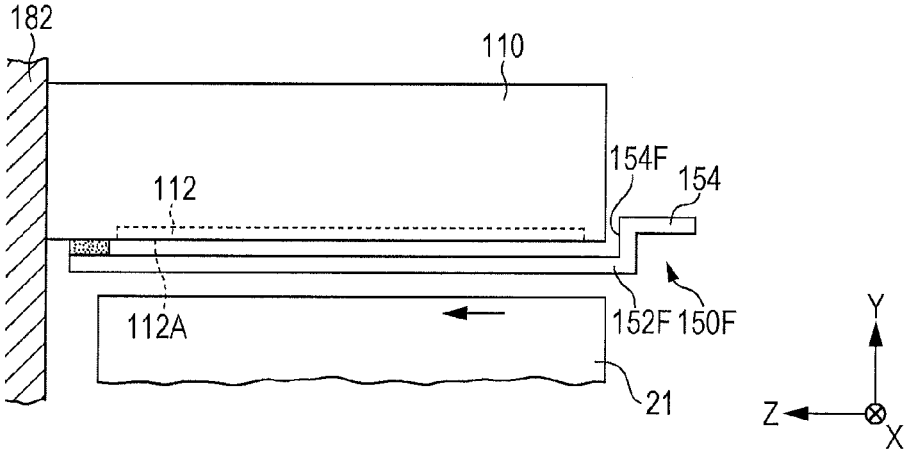
Figure 13C:
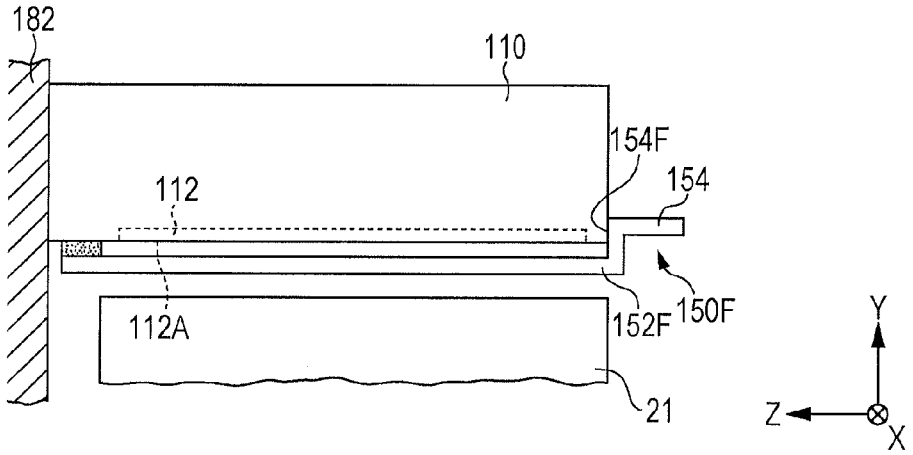

In addition, the distance L5 is set to be smaller than the distance L3 of the container 110 in the apparatus depth direction (see FIGS. 13B and 13C). Note that the distal end of the container 110 in the apparatus depth direction is fixed to the housing 182 that is included in an image forming apparatus (see FIG. 13A). The housing 182 has a plate-like shape that is formed along the apparatus height direction (see FIG. 13A). In other words, the housing 182 is disposed at a position that is spaced apart from the proximal end of the container 110 in the apparatus depth direction by the distance L3 on an extension line that extends in a direction in which the cleaning portion 156 moves when a cleaning operation is performed (see FIG. 13A).

As illustrated in FIG. 13A, the holding portion 154 has a step surface 154F. The step surface 154F is capable of interfering with a portion of the container 110 on the proximal side in the apparatus depth direction as seen from the apparatus depth direction. Therefore, when the support portion 152F moves toward the distal side in the apparatus depth direction, the step surface 154F makes contact with the side wall of the container 110 on the proximal side in the apparatus depth direction.

In the above description of the reference example, the holding portion 154 makes contact with the side wall of the container 110 on the proximal side in the apparatus depth direction, so that the cleaning portion 156 does not make contact with the housing 182. However, the reference example is not limited to this configuration as long as, in the case where a component that is included in an image forming apparatus 10 and the like are disposed in front of the housing 182 in the apparatus depth direction, the cleaning portion 156 does not make contact with such a component and the like.

Effects of Reference Example

First, assume Comparative Example 2 (not illustrated) is a comparative example of the cleaning device 140F of the reference example. In Comparative Example 2, the distance from an end of a support portion on the side of a holding portion to an end of a cleaning portion on the side opposite to that on which the support portion is disposed in the longitudinal direction of a cleaning member is a distance L7, and a difference from the reference example is that the distance L7 is longer than the distance L3.

In Comparative Example 2, when the cleaning portion of the cleaning member makes contact with a housing, and in addition, the cleaning member is pressed toward the distal side in the apparatus depth direction, a compressive stress is applied to the support portion of the cleaning member, and the support portion is elastically deformed in a convex manner toward one side in the apparatus height direction. In the case where the support portion is elastically deformed on the side of a transmission glass, a portion of the support portion makes contact with a surface of the transmission glass, and scratches are formed on the surface of the transmission glass.

In the case where scratches are formed on the surface of the transmission glass due to this configuration, part of an exposure light beam L that penetrates the transmission glass may be scattered due to the scratches, and a light exposure failure may occur when an image forming operation is performed.

In contrast, the cleaning device 140F of the reference example will be described with reference to FIGS. 13A to 13C. When the cleaning portion 156 (a wiping portion 162) passes through a distal end of a cleaning area CL in the apparatus depth direction (see FIG. 13B) and further moves toward the distal side in the apparatus depth direction, the step surface 154F makes contact with the side wall of the container 110 on the proximal side in the apparatus depth direction. Therefore, it is difficult for the cleaning portion 156 to further move toward the distal side in the apparatus depth direction.

In other words, in the cleaning device 140F, unlike Comparative Example 2, after the cleaning portion 156 has passed through the cleaning area CL, the support portion 152F will not be held in a state of being pressed in the apparatus depth direction. Thus, unlike Comparative Example 2, in the cleaning device 140F, it is not likely that a portion of the support portion 152F will make contact with a surface 112A of the transmission glass 112 and that scratches will be formed on the surface 112A of the transmission glass 112.

Therefore, in the case where the cleaning device 140F of the reference example is employed, formation of scratches on the surface 112A of the transmission glass 112 is suppressed as compared with Comparative Example 2.

The rest of the effects of the reference example is similar to those of the above-described first to fourth exemplary embodiments.

Note that in the case where the distance L5 is set to be larger than the distance L3, a configuration in which the cleaning portion 156 does not make contact with a portion of the housing 182 on the extension line that extends in the direction in which the cleaning portion 156 moves may be employed. In other words, a hole (not illustrated) in which the cleaning portion 156 is capable of being received may be formed in the portion of the housing 182 on the extension line that extends in the direction in which the cleaning portion 156 moves.

Although the specific exemplary embodiments of the present invention have been described in detail above, the present invention is not limited to the above-described exemplary embodiments and may employ other various exemplary embodiments within the scope of the present invention.

For example, in the above-described first exemplary embodiment, the inclined member 180 has a plane that is inclined at an angle of 30 degrees with respect to the apparatus depth direction. However, the inclined member 180 may have a curved surface, multiple planes each of which is inclined at a different angle, or a combination of these planes as long as the support portion 152 is bent in a convex manner toward the side opposite to that on which the transmission glass 112 is disposed after the cleaning portion 156 has passed through the cleaning area CL.

In the above-described first to fourth exemplary embodiments, the surface 112A of the transmission glass 112 is a plane. However, the surface 112A is not limited to a plane and may be, for example, a curved surface, a complex surface that includes a curved surface and a plane, or the like.

In the above-described first to fourth exemplary embodiments, the base portion 166 is disposed on an end side of the support portion 152. However, the base portion 166 may be formed on an end of the support portion 152 as a portion of the support portion 152.

In the above-described first to fourth exemplary embodiments, the elastic portion 160 and the wiping portion 162, which are included in the cleaning portion 156, are disposed on one side in the width direction of the support portion 152. However, the elastic portion 160 and the wiping portion 162 may also be disposed on the other side in the width direction of the support portion 152. In this case, when the cleaning member 150 is inserted into an area between the rib 124 and the rib 132 of the container 110 at the time of performing a cleaning operation, the cleaning member 150 may be used with one surface and the other surface thereof in the width direction of the cleaning member 150 reversed.

In the above-described first exemplary embodiment, the inclined surface 184 of the inclined member 180 is a plane. However, the inclined surface 184 may be formed of, for example, a curved surface, a complex surface that includes a curved surface and a plane, or the like as long as the inclined surface 184 is a plane that is formed along a direction that intersects the longitudinal direction of the transmission glass 112.

In the above-described second to fourth exemplary embodiments, the cleaning device 140A includes the plate-shaped member 186, which is formed along the apparatus height direction. However, the plate-shaped member 186 may be a housing of the image forming apparatus 10 or the like.

In addition, in the above-described second to fourth exemplary embodiments, the grooves 152C1 are formed in a portion of the support portion 152C on the side of the transmission glass 112. However, the number of the grooves 152C1 may be one as long as the support portion 152C is bent in a convex manner toward the side opposite to that on which the transmission glass 112 is disposed after the cleaning portion 156 has passed through the cleaning area CL.

In the above-described second to fourth exemplary embodiments, the cleaning member 150 is inserted into an area between the rib 124 and the rib 132 of the container 110 when a cleaning operation is performed. However, the cleaning member 150 may be arranged at a predetermined position in the container 110 when an image formation is performed. For example, a hole having an elongated shape is formed in the support portion 152 in the apparatus height direction (a plate thickness direction), and the cleaning portion 156 is positioned further toward the distal side in the apparatus depth direction than the cleaning area CL. Then, when an image formation is performed, the exposure light beam L may pass through the hole having an elongated shape of the support portion 152.

Although in the above description, the first to fourth exemplary embodiments (including the modifications) are separated from one another, two or more characteristic configurations of the exemplary embodiments may be combined and implemented. For example, the inclined member 180 of the first exemplary embodiment and a cleaning member 150D of the fourth exemplary embodiment may be combined. In addition, the cleaning member 150C of the third exemplary embodiment and the image forming apparatus 10 of the first exemplary embodiment may be combined. Furthermore, the cleaning member 150B of the second exemplary embodiment and the grooves 152C1 of the cleaning member 150C of the third exemplary embodiment may be combined.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning member that includes a cleaning portion that cleans a light transmission member, which has a substantially elongated shape and which transmits light, and a support portion that supports the cleaning portion; and a wall portion that is disposed on one end side of the light transmission member in a longitudinal direction of the light transmission member and that has a surface that is formed along a direction that intersects the longitudinal direction of the light transmission member, wherein the cleaning member and the wall portion each have a configuration in which when an end of the cleaning member makes contact with the wall portion and is pressed against the wall portion, the support portion bends in a convex manner toward a side opposite to a side on which the light transmission member is disposed, so that the support portion is closer to the opposite side than when the end of the cleaning member does not make contact with the wall portion and is not pressed against the wall portion.

2. The cleaning device according to claim 1, wherein the wall portion is inclined with respect to the longitudinal direction, and wherein when the cleaning member makes contact with an end of the wall portion and is pressed, an end portion of the cleaning member is guided and bent toward the side of the light transmission member.

3. An image forming apparatus comprising:

a light radiation device that includes a light source and a light transmission member that transmits light, which is emitted from the light source and radiated onto a member to be light-irradiated; and the cleaning device according to claim 1 that cleans a surface of the light transmission member by using a cleaning portion.

4. An image forming apparatus comprising:

a light radiation device that includes a light source and a light transmission member that transmits light, which is emitted from the light source and radiated onto a member to be light-irradiated; and the cleaning device according to claim 2 that cleans a surface of the light transmission member by using a cleaning portion.

* * * * *